United States Patent [19]

Schukantz

[11] 4,156,869

[45] May 29, 1979

[54] CONDUCTING CABLE

[75] Inventor: James H. Schukantz, San Diego, Calif.

[73] Assignee: The United States of America as represented by the Secretary of the Navy, Washington, D.C.

[21] Appl. No.: 807,860

[22] Filed: Jun. 20, 1977

[51] Int. Cl.[2] ..... H01B 7/14

[52] U.S. Cl. ..... 340/310 A; 174/108; 174/115; 405/191; 340/6 R

[58] Field of Search ..... 174/115, 108; 340/310 A

[56] References Cited

U.S. PATENT DOCUMENTS

| | | | |
|---|---|---|---|
| 1,946,190 | 2/1934 | Brodhun | 174/108 |
| 2,180,731 | 11/1939 | Dickinson | 174/115 |
| 4,010,619 | 3/1977 | Hightower et al. | 174/115 |

FOREIGN PATENT DOCUMENTS

| | | | |
|---|---|---|---|
| 1167964 | 10/1969 | United Kingdom | 174/115 |

*Primary Examiner*—Richard R. Kucia

*Attorney, Agent, or Firm*—Richard S. Sciascia; Ervin F. Johnston; James O. Skarsten

[57] ABSTRACT

In a cable for conveying information signals of selected frequencies and for simultaneously conveying a selected amount of electric power, a central conducting means is surrounded by a dielectric material. An outer conducting means is positioned around the dielectric, and cooperates with the central conducting means to provide a first path, through which the information signals are conveyed, and one of the conducting means provides a second path, through which the electric power is conveyed.

6 Claims, 6 Drawing Figures

RF OUT
3Ø LOAD
RF IN
3Ø POWER

CONDUCTING CABLE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The invention herein disclosed and claimed pertains generally to cables which are adapted to convey both information signals and electric power. More particularly, the invention pertains to improvements in such cables for reducing wear or other mechanical deterioration thereof.

To operate a remotely controlled vehicle such as a tethered vehicle, it may be necessary to couple both control signals and power thereto, and various designs are presently available for an electrically conductive cable through which both signals and power may be simultaneously conveyed to the vehicle from a command station. In such combination cables a coaxial cable, through which control or other information signals may be transmitted, may be encased together with two or more electrical conductors, which are large enough to carry substantial amounts of electric current. The cable may also have to include strengthening means to meet a minimum tensile strength requirement, and if used in a marine environment, e.g. to tether a remotely controlled underwater vehicle, may require flotation or other devices to achieve a specified buoyancy.

In addition to the above requirements, a combination cable may have to have a minimum bend radius under tension to be useful in certain important applications. For example, to enable efficient storage, deployment or recovery, the cable may have to be sufficiently flexible to be wound upon a drum or to pass over a sheave. If the cable does not have sufficient flexibility for such operating conditions, wear or other mechanical deterioration will be hastened. Yet the other aforementioned requirements, for strengthening and buoyancy means encased together with separate signal and power conductors, may serve to reduce flexibility.

SUMMARY OF THE INVENTION

The present invention provides a cable for conveying control or other information signals of selected frequencies and for simultaneously conveying a selected amount of electric power. The invention generally comprises a central conducting means, a material of selected dielectric coefficient which surrounds the central conducting means, and an outer conducting means which is positioned around the dielectric, the outer conducting means cooperating with the central conducting means to provide a first path through which the information signals are conveyed, and one of the conducting means providing a second path through which the electric power is conveyed. By providing a cable in which one of the aforementioned conducting means performs a dual conductive function, cable components may be reduced, whereby flexibility may be improved while maintaining other operational capabilities. Alternatively, a cable may be constructed according to the present invention with improved conductivity, tensile strength and/or buoyancy without reducing the flexibility thereof.

In a first embodiment of the invention the central conducting means comprises a central conductor which substantially coincides with the axis of the cable along the length thereof, and the dielectric has cylindrically shaped outer surface. The outer conducting means comprises a plurality of power conductors, each power conductor being helically wrapped around the dielectric, and each conductor comprising an electrically conductive element surrounded by an insulation layer. Dimensions of the conductive elements and insulation layers are respectively selected so that a minimum proportion of the outer surface of the dielectric is surrounded by the conductive elements of the wrapped power conductors, whereby the elements together form an outer conductor or shield for a coaxial cable, the central conducting means providing the inner conductor therefor. The coaxial cable provides the aforementioned path for conveying information signals, and the power conductors provide the path for the aforementioned power.

Preferably, each conductive element comprises a strip or tape of conducting material, and each power conductor comprises a flat member, the power conductors being helically wrapped around the dielectric so that adjacent edges of adjacent power conductors are maintained in contact, and one face of each power conductor is maintained in contact with the outer surface of the dielectric. By providing flat power conductors wrapped in such manner, each power conductor is less likely to be damaged by compression occurring when the cable is bent under tension. In addition, adjacent conductors are less likely to be spread or separated under compression, which would cause uneveness in the coaxial shield formed by conductive elements of the power conductors.

In a second embodiment of the invention, the central conducting means comprises a plurality of power conductors, each of the power conductors being proximate to the axis of the cable along the length of the cable, and the dielectric has a cylindrically shaped outer surface. The outer conducting means comprises a conducting material which surrounds the dielectric material, and preferably comprises a flat strip or tape of conducting material which is helically wrapped around the outer surface of the dielectric material along the length thereof. The outer conductor forms a shield for a coaxial cable, the inner conductor therefor comprising the aforementioned power conductors.

A cable structured according to either of the above embodiments may additionally be provided with a strength member to increase the tensile strength thereof, and may be suitable to couple both information and power between a command station and an underwater remotely controlled vehicle. However, it is not intended to limit the present invention to such embodiments or applications.

OBJECTS OF THE INVENTION

An object of the present invention is to provide an improved cable for simultaneously conveying information signals of selected frequency and electric power.

Another object is to provide an improved cable for simultaneously conducting signals of RF frequencies, and power in sufficient amounts to operate mechanical equipment.

Another object is to improve the mechanical flexibility of cables of the above type, and particularly cables of the above type which are to be employed in a marine environment.

Another object is to provide an electrically conductive cable which may be subject to periodic bending under tension, and which includes flat, helically wrapped conducting means to resist reduction of its conductive capability by wear or other mechanical deterioration.

Other objects of the invention will become more readily apparent from the ensuing specification when taken together with the drawings.

DESCRIPTION OF THE PREFERRED EMBODIMENT

Figure 1:
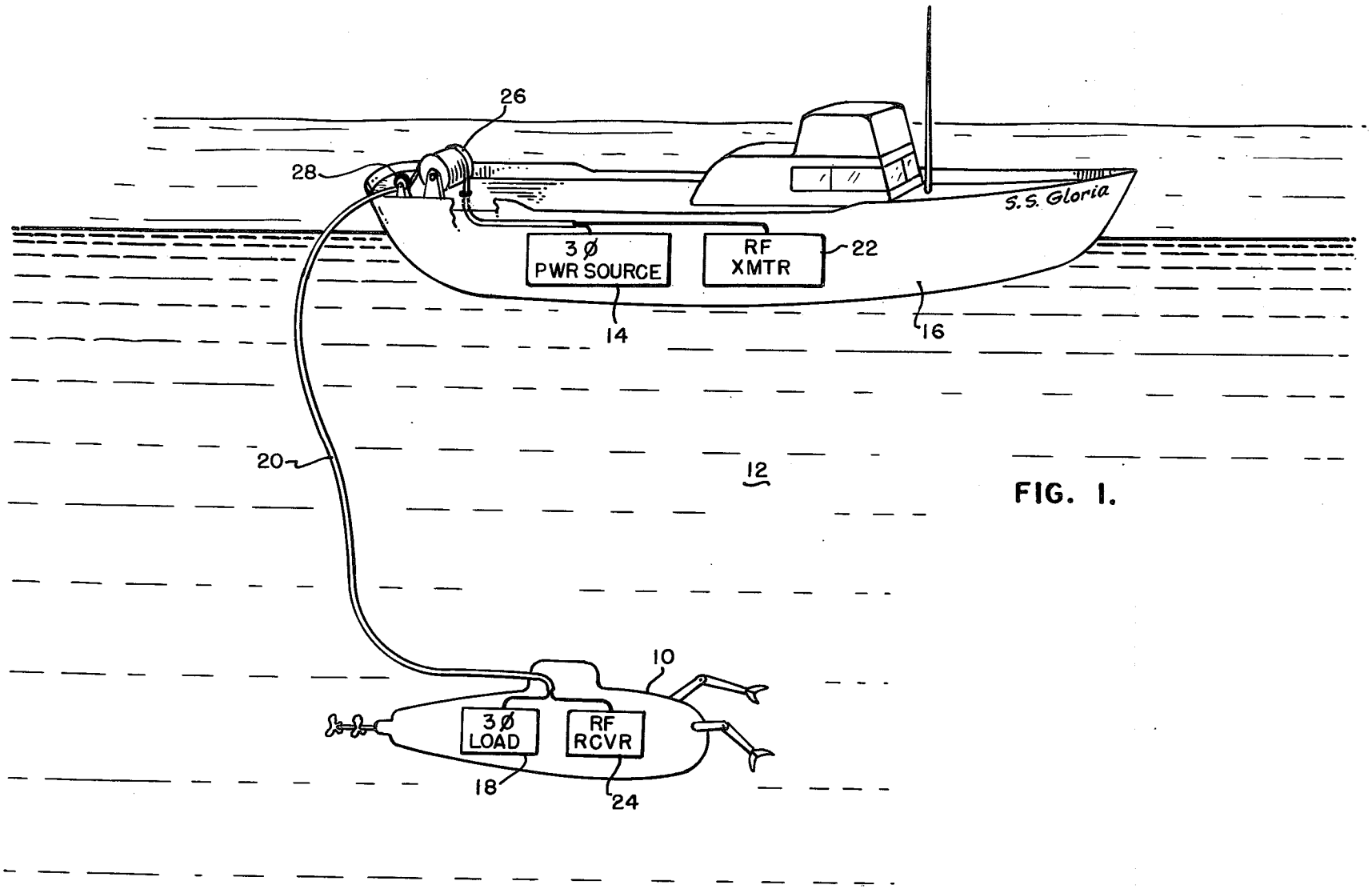
FIG. 1 is a perspective view showing an environment in which an embodiment of the invention may be employed.

Referring to FIG. 1, there is shown a remotely controlled vehicle 10 designed to operate in a marine environment 12, such as an ocean body. Vehicle 10 may be provided with propulsion and direction control systems, and also with various types of sensing devices or mechanical equipment located externally thereupon, whereby vehicle 10 is enabled to perform useful tasks of a given type in environment 12. Power source 14 is located at a command station aboard a suitable platform, such as vessel 16, and couples 3-phase power of 1400 volts to 3-phase load 18 through cable 20, which is structured according to the principles of the present invention. Load 18 is located aboard vessel 10 and comprises the power requirement for operating all of the electrical and mechanical systems thereof.

To control the operations of vehicle 10, control signals, such as signals having frequencies in the RF spectrum 0.8 MHz to 20 MHz, are coupled through cable 20 from an RF transmitter 22 located at the command station to an RF receiver 24 aboard vehicle 10.

Referring further to FIG. 1, it may be noted that cable 20 must be sufficiently flexible to be wound around drum 26 and to be passed through sheave 28 while being deployed or recovered. In addition, cable 20 must have a minimum tensile strength and a selected buoyancy.

Figures 2, 3, 4, 5, 6:
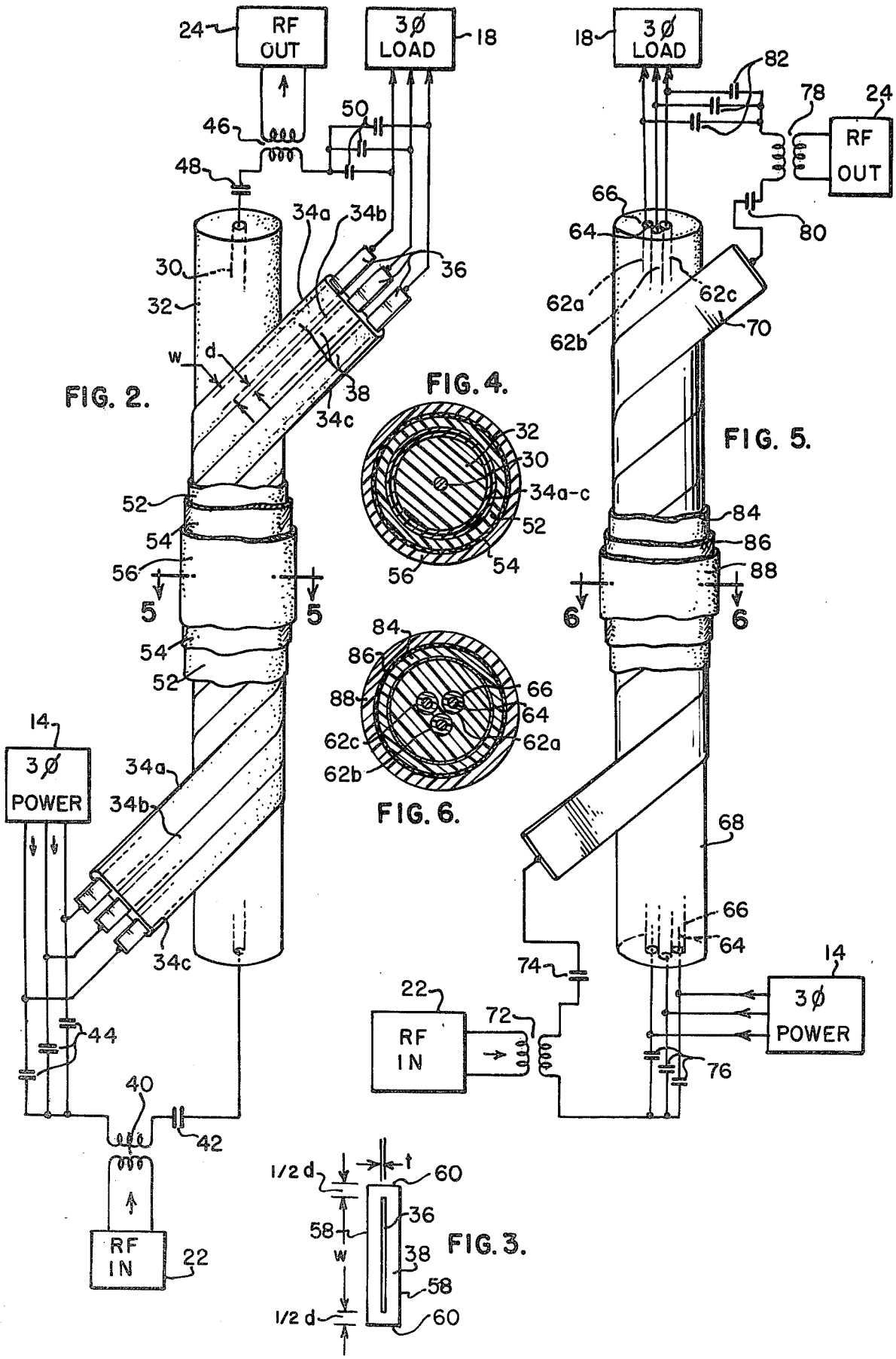
FIG. 2 is a perspective view of a first cable structured according to the principles of the invention.
FIG. 3 is a cross-sectional view of a power conductor of the cable of FIG. 2.
FIG. 4 is a cross-sectional view of the cable of FIG. 2.
FIG. 5 is a perspective view of a second cable structured according to the principles of the invention.
FIG. 6 is a cross-sectional view of the cable of FIG. 5.

Referring to FIG. 2, there is shown a first cable for performing the functions of cable 20, wherein a central conductor 30 substantially coincides with the axis of the cable along the length thereof. Central conductor 30 comprises a strand of conducting material, such as aluminum or copper, and since it is not intended to carry any line current may have a diameter of less than 0.1", the minimal size thereof being determined by RF loss requirements. Conductor 30 is surrounded by a dielectric material 32, such as TPX or dielectric foam, which has a cylindrical outer surface. The outer diameter of dielectric 32 may usefully be 0.5", and the dielectric coefficient thereof may be 2–2.5.

Each of the power conductors 34 *a–c* shown in FIG. 2 comprises a flat, electrically conductive member which is helically wrapped around dielectric 32, adjacent edges of adjacent power conductors being maintained in contact, and one face of each of the power conductors being maintained in contact with the outer surface of dielectric 32. Each power conductor includes a conducting strip 36, comprising aluminum foil or other conducting material, which is contained within an insulation layer 38 of suitable material, each strip 36 having a width w. Adjacent strips 36 of adjacent wrapped power conductors are separated by a distance d, which is determined by the thickness of insulation 38, d being sufficient to prevent voltage breakdown for transmission of power of 1400 Volts.

The width w of the strips 36 is selected to be much greater than the distance d therebetween, whereby conducting strips 36 together surround over 90% of the outer surface of dielectric 32. Consequently, by connecting power conductors 34*a–c* in parallel between RF transmitter 22 and RF receiver 24, the conducting strips 36 comprise the shield or outer conductor for a coaxial cable, the inner conductor therefor comprising central conductor 30. The coaxial cable formed by conducting strips 36 and central conductor 30 is capable of conveying signals having frequencies in the aforementioned RF spectrum, while 3-phase power of the aforementioned voltage is conveyed through power conductors 34*a–c*. Respective ends of conductors 34*a–c* are respectively coupled to output terminals of 3-phase source 14 and to 3-phase load 18. Control signals are coupled to the coaxial cable formed by strips 36 and conductor 30 through coil 40, capacitor 42, and capacitors 44, and the control signals are received from the coaxial cable through coil 46, capacitor 48, and capacitors 50.

Referring further to FIG. 2, there are shown portions of three additional layers, inner jacket 52, strength member 54, and outer jacket 56, which are positioned around the cable shown in FIG. 2 along the length thereof. Strength member 54 may comprise a layer of material conventionally known as Kevlar, to provide tensile strength, and to contribute to the buoyancy of the cable. Inner jacket 52, which may comprise a layer of polyvinyl, is sandwiched between strength member 54 and power conductors 34 *a–c* to cushion the power conductors from the strength member, and outer jacket 56 may also comprise a layer of polyvinyl and provides a protective covering for the cable. The outer diameter of the cable shown in FIG. 2 may usefully be 0.66", and the respective thicknesses of layers 52, 54, and 56 may be readily determined by one skilled in cable technology or related arts for specified operational requirements.

Referring to FIG. 3, there is shown a power conductor having faces 58, and a conducting strip 36 having width w, as aforementioned, and a thickness t, the cross-sectional area of each strip 36, w t, being selected to meet the current carrying and resistance requirements of the power conductors 34 *a–c*. Each strip 36 lies substantially parallel to the faces 58 of its power conductor, and the ends of each strip 36 are a distance one-half d from the edges 60 of its power conductor to provide the aforementioned distance d between conducting strips 36.

Referring to FIG. 4, there is shown a cross section of the cable shown in FIG. 2, further illustrating the positioning of respective layers or components thereof. The characteristic impedance of the cable shown in FIGS. 2 and 4 may be 100 Ohms.

Referring to FIG. 5, there is shown a cable having a central conducting means which comprises three power conductors 62 *a–c*, each power conductor comprising a strand of 12 gauge aluminum wire 64, insulated by a suitable material 66. Power conductors 62 *a–c* are surrounded by a dielectric material 68, such as TPX or dielectric foam, which has a cylindrically shaped outer surface and may usefully have an outer diameter of 0.5" and a dielectric coefficient of 2–2.5.

A flat conducting strip or tape 70, of material such as aluminum foil, is helically wrapped around dielectric 68, the inner face thereof being maintained in contact with the outer surface of dielectric 68, and an edge of each successive wrap of strip 70 overlapping the adjacent edge of an adjacent wrap, whereby the outer surface of dielectric 68 is entirely surrounded by the conducting strip 70. Consequently, conducting strip 70 comprises the shield or outer conductor for a coaxial cable, the inner conductor therefor formed by connecting power conductors 62 *a–c* in parallel. The cross-sectional dimensions of strip 70 are determined by skin current requirements of the RF spectrum being used, and each of the power conductors 62 *a–c* is of sufficient dimensions to convey power of the aforementioned voltage from source 14 to load 18. Control signals are coupled from transmitter 22 into the coaxial cable formed by conducting strip 70 and conductors 62 *a–c* through coil 72, capacitor 74, and capacitors 76. The control signals are received by receiver 24 from the coaxial cable through coil 78, capacitor 80, and capacitors 82.

Referring further to FIG. 5, there are shown portions of three additional layers, inner jacket 84, strength member 86, and outer jacket 88, which are positioned around the cable shown in FIG. 5 along the length thereof. Strength member 86 may comprise a layer of Kevlar to provide both tensile strength and contribute to the buoyancy of the cable. Inner jacket 84, which may comprise a layer of polyvinyl, is sandwiched between strength member 86 and conducting strip 70 to cushion the conducting strip from the strength member, and outer jacket 88 may also comprise a layer of polyvinyl to provide a protective covering for the cable. The outer diameter of the cable shown in FIG. 5 may usefully be 0.66", and the respective thicknesses of layers 84, 86, and 88 may be readily determined by one skilled in cable technology or related arts for specified operational requirements.

Referring to FIG. 6, there is shown a cross section of the cable shown in FIG. 5, further illustrating the positioning of respective layers or components thereof. The characteristic impedance of the cable shown in FIGS. 5 and 6 may be 30 Ohms.

Obviously, many modifications and variations of the present invention are possible in the light of the above teachings, and, it is therefore understood that within the scope of the disclosed inventive concept, the invention may be practiced otherwise than as specifically described.

What is claimed is:

1. A cable apparatus for conveying information signals of selected frequencies from a signal transmitting means to a signal receiving means, and for further conveying a selected amount of electric power from a power source to a power load, said cable apparatus comprising:

central conducting means coinciding with the axis of said cable apparatus along the length of said cable apparatus;

material of selected dielectric coefficient having a cylindrical outer surface, said dielectric material surrounding said central conducting means, said dielectric material having an axis which coincides with the axis of said cable apparatus along the length of said cable apparatus;

outer conducting means comprising a plurality of flat power conductors, each of said flat power conductors comprising a strip of conducting material of selected width and thickness surrounded by a layer of insulation, each of said insulation layers having a flat external surface, each of said flat power conductors being helically wrapped around said dielectric material along the length of said cable apparatus so that the flat external surface of the insulation layer of each of of said helically wrapped power conductors is maintained in contact with said outer surface of said dielectric material and so that adjacent conducting strips of said helically wrapped power conductors are separated by a specified distance, said outer conducting means for providing a path for said electric power from said power source to said power load, and for simultaneously providing the outer conductor for a coaxial cable which conveys said information signals from said signal transmitting means to said signal receiving means, said central conducting means comprising the inner conductor for said coaxial cable, and said dielectric material comprising the dielectric for said coaxial cable.

2. The cable apparatus of claim 1 wherein:

said central conducting means comprises a single strand of conducting meaterial which lies along the axis of said cable apparatus along the length of said cable apparatus, said strand of conducting material being in contact with said dielectric material along the length of said cable apparatus; and said specified distance separating adjacent conducting strips of said helically wrapped power conductors has such relation to the width of each of said conducting strips that said conducting strips collectively surround a sufficient proportion of said outer surface of said dielectric material to enable said outer conducting means to provide said outer conductor for said coaxial cable.

3. The cable apparatus of claim 2 wherein:

said specified distance has such relation to the width of each of said conducting strips that said conducting strips of said wrapped power conductors collectively surround in excess of 90% of the outer surface of said dielectric material.

4. The cable apparatus of claim 2 wherein:

said cable apparatus is provided with an inner jacket means positioned between said outer conducting means and a strengthening means, and outer jacket means covering said strengthening means along the length of said cable apparatus.

5. A system for conveying information signals of selected frequency and for further conveying electric power from a first location to a second location, said system comprising:

means for transmitting said information signals positioned at said first location;

means for receiving said information signals positioned at said second location;

source means for generating said electric power positioned at said first location;

load means for receiving said power positioned at said second location;

central conducting means coupled between said means for transmitting said information signals and said means for receiving said information signals;

material of selected dielectric coefficient surrounding said central conducting means, said dielectric material having a cylindrical outer surface and a central axis coinciding with an axis of said central conducting means; and outer conducting means comprising a plurality of flat power conductors which are coupled in parallel between said means for transmitting said information signals and said means for receiving said information signals, each of said flat power conductors being further coupled between said source means and said load means for providing a plurality of discrete electrically conductive paths for conveying said electric power, each of said flat power conductors being helically wrapped around said outer surface of said dielectric material, a flat surface of each of said helically wrapped power conductors being maintained in contact with said outer surface of said dielectric material.

6. A system for conveying information signals of selected frequency and for further conveying electric power from a first location to a second location, said system comprising:

means for transmitting said information signals positioned at said first location;

means for receiving said information signals positioned at said second location;

source means for generating said electric power positioned at said first location;

load means for receiving said power positioned at said second location;

central conducting means comprising a plurality of power conductors which are coupled in parallel between said means for transmitting said information signals and said means for receiving said information signals, each of said power conductors being further coupled between said source means and said load means for providing a plurality of discrete electrically conductive paths for conveying said electric power;

material of selected dielectric material surrounding said central conducting means, said dielectric material having a cylindrical outer surface and a central axis which is proximate to each of said power conductors; and a flat strip of electrically conductive material helically wrapped around said outer surface of said dielectric material so as to entirely surround the outer surface of said dielectric material.

* * * * *